US010209000B2

(12) United States Patent
Basso

(10) Patent No.: US 10,209,000 B2
(45) Date of Patent: Feb. 19, 2019

(54) COOLING ARRANGEMENT FOR REFRIGERATORS

(71) Applicant: CERVECERÍA Y MALTERIA QUILMES S.A.I.C.A. y G., Ciudad Autónoma de Buenos Aires (AR)

(72) Inventor: Diego Fabricio Basso, Buenos Aires (AR)

(73) Assignee: CERVECERIA Y MALTERIA QUILMES S.A.I.C.A. Y G., Ciudad Autónoma de Buenos Aires (AR)

( * ) Notice: Subject to any disclaimer, the term of this patent is extended or adjusted under 35 U.S.C. 154(b) by 0 days.

(21) Appl. No.: 15/429,848

(22) Filed: Feb. 10, 2017

(65) Prior Publication Data

US 2017/0234601 A1 Aug. 17, 2017

(30) Foreign Application Priority Data

Feb. 11, 2016 (AR) ..... P160100372

(51) Int. Cl.

| | |
|---|---|
| ***A47B 96/04*** | (2006.01) |
| ***F25D 23/02*** | (2006.01) |
| ***F25D 11/02*** | (2006.01) |
| ***F25D 25/00*** | (2006.01) |
| ***A47F 1/08*** | (2006.01) |
| ***F25D 23/04*** | (2006.01) |
| ***G07F 11/28*** | (2006.01) |
| ***G07F 9/10*** | (2006.01) |

(52) U.S. Cl.

CPC ..... *F25D 23/028* (2013.01); *A47F 1/087* (2013.01); *F25D 11/02* (2013.01); *F25D 23/025* (2013.01); *F25D 23/04* (2013.01); *F25D 25/005* (2013.01); *G07F 9/105* (2013.01); *G07F 11/28* (2013.01); *F25D 2331/805* (2013.01); *F25D 2400/36* (2013.01); *F25D 2700/121* (2013.01)

(58) Field of Classification Search

CPC ..... F25D 23/028

USPC ..... 312/321.5, 405, 405.1; 62/63, 377, 381

See application file for complete search history.

(56) References Cited

U.S. PATENT DOCUMENTS

| | | | | |
|---|---|---|---|---|
| 5,042,398 | A * | 8/1991 | Lau | A47F 5/005 108/108 |
| 5,462,198 | A * | 10/1995 | Schwimmer | G07F 11/34 221/130 |
| 6,260,362 | B1 * | 7/2001 | Choi | F25D 29/00 62/186 |
| 2005/0144970 | A1 * | 7/2005 | Cho | E05C 19/028 62/441 |
| 2007/0157655 | A1 * | 7/2007 | Eveland | A47F 1/087 62/377 |
| 2009/0193823 | A1 * | 8/2009 | Lee | F25D 23/12 62/125 |
| 2010/0072870 | A1 * | 3/2010 | Hwang | F25D 23/025 312/405 |

* cited by examiner

*Primary Examiner* — Matthew W Ing
(74) *Attorney, Agent, or Firm* — Arent Fox LLP

(57) ABSTRACT

A cooling arrangement for refrigerators is provided, which allows better control and temperature maintenance for beverage cans, which facilitates access to them without having to open other cooling chamber of the refrigerator and also prevents an abrupt shift of the cans which can generate overflows of the liquid contents when opening them.

9 Claims, 3 Drawing Sheets

COOLING ARRANGEMENT FOR REFRIGERATORS

CROSS-REFERENCE TO RELATED APPLICATIONS

This application claims priority to Argentine Patent Application No. P160100372, filed Feb. 11, 2016. The disclosure of the priority application is incorporated in its entirety herein by reference.

STATE OF THE ART OF THE INVENTION

Field of the Invention

The present invention relates to the field of devices, appliances and arrangements for household, public, or labor use, etc. used for cooling products, or packaging containers of products, preferably of mass consumption, such as beverages and, more preferably containers or cans, and more particularly the invention relates to a cooling arrangement of these products, preferably used in home refrigerators, which allows better cooling and easier access to them in a faster and more practical way.

Description of the Prior Art

Refrigerators for products in general, whether industrial use, household use, public use, dispensers, etc. consist of an insulated cabinet that encloses what is called a cold or cooling chamber. Household refrigerators or coolers, comprise, in general, these cabinets with their inside divided into two parts, a lower part dedicated to cooling of the products, foods, etc. in general, within a main space or chamber having a main access door to it, and a upper part, dedicated to a greater cooling or freezing of some special products. This top, smaller part, can be a freezer with higher cold than in the main chamber, or may be a freezer with even lower temperatures, down to −20° C. In the main chamber, meanwhile, it is usual to find a temperature of about 6° C., cold enough for foods that are stored there.

For some products, however, none of these temperatures are the most appropriate for conditioning. For example, beer beverage cans are typical products which in accordance with the customs of some countries, particularly in South America, can be consumed at temperatures below the 6° C. of the main cooling chamber, but above the −20° C. of the freezer. In addition, conventional refrigerators do not have a special design for cans; they are usually housed in some uncomfortable sector of the main doors. This in turn, means that when opening and closing the door, the cans might move from side to side in an abrupt way, they might shake and consequently, the beverage would overflow when opened.

On the other hand, there are coolers and refrigerators designed to generate and maintain desired temperatures for these products such as beer, but they are special refrigerators for food outlets, restaurants, bottle dispensers, etc. However, household refrigerators or coolers which are adapted or have special compartments for conditioning beer and other products, which preserve these products at a sectored temperature and present an easy access to them quickly, easily and selectively, are not known.

Therefore, it would be highly desirable to have a new arrangement either embedded in refrigerators at the factory or adaptable to household refrigerators or coolers already manufactured, which preserve products such as containers of various tin-shaped products at a suitable temperature using the cold-generating capacity of the coldest part of the cooling chambers, presenting a direct access to these products without having to open the other cooling chambers of the refrigerator and in turn, to avoid the shifting of cans in an abrupt way.

BRIEF DESCRIPTION OF THE INVENTION

It is therefore an object of the present invention to provide a cooling arrangement for refrigerators which allows creating a space of selected and controlled temperatures for products that require so and presenting a direct access to these products without having to open other cooling chambers of the refrigerator.

It is yet another object of the present invention to provide a cooling arrangement for refrigerators, wherein the refrigerator may have one or more doors, and wherein at least one of said doors, preferably the access door of the colder chamber of the refrigerator, comprises a compartment for housing and maintenance of differentiated products.

It is yet another object of the present invention to provide a cooling arrangement for refrigerators that prevents abrupt movement of the cans.

It is still another object of the present invention to provide a cooling arrangement for refrigerators of the type having at least one access door to at least one cooling chamber of the refrigerator, wherein said at least one access door comprises a compartment defined by a front panel, an inner panel, and a inclined housing structure for consumer products, said front panel being provided with a display/unloading window together with a pivotable closure flap for accessing the cans, while said inner panel is provided with a plurality of slots for the passage of cold air and a loading window of such cans.

BRIEF DESCRIPTION OF THE DRAWINGS

For clarity and understanding of the object of the present invention, it has been illustrated in several figures, in which the invention has been represented in one of the preferred embodiments, all by way of example, wherein.

DETAILED DESCRIPTION OF THE INVENTION

Figure 1:
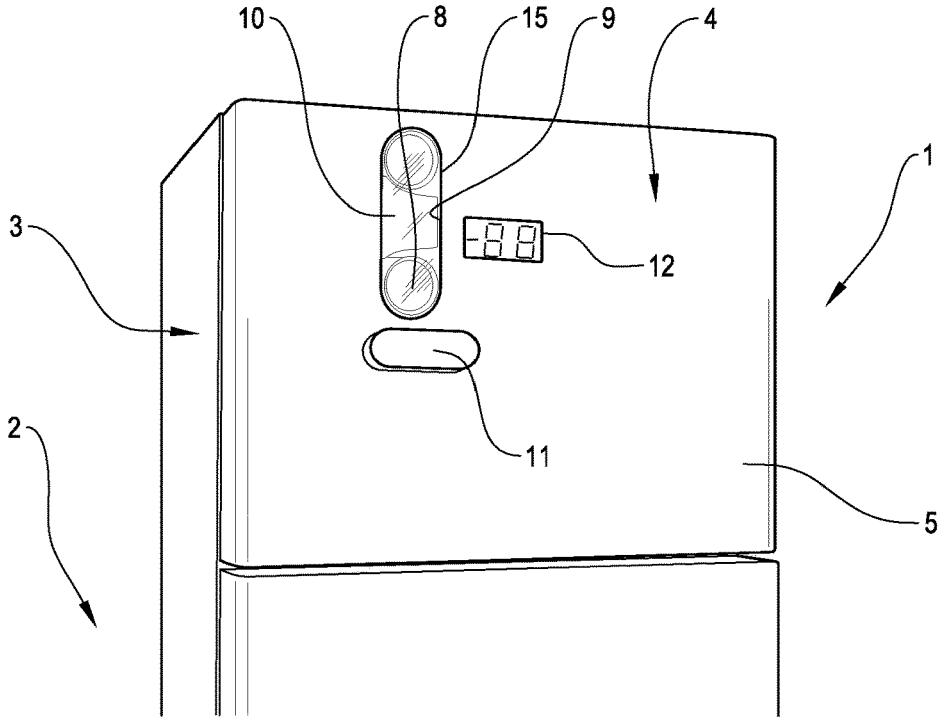
FIG. 1 shows a perspective and partial view of a household refrigerator or cooler of the type having two doors, a lower or principal for accessing the main cooling chamber of the refrigerator and an upper door for accessing the freezer, the refrigerator being provided with the cooling arrangement of the invention.
Figure 2:
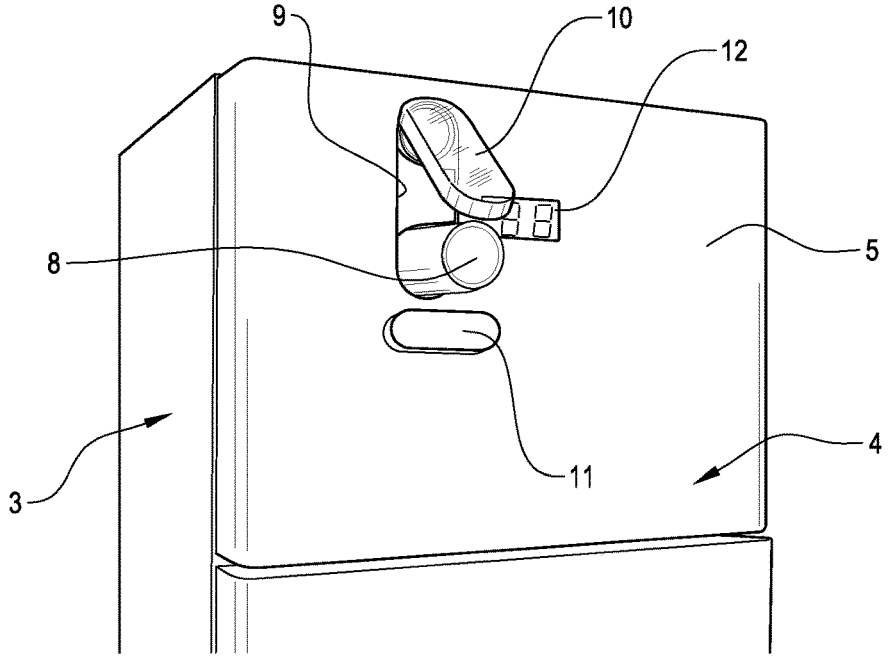
FIG. 2 shows a perspective view of the upper door of the freezer, where an application form thereof, in this case, of the removal of a can, is shown.
Figure 3:
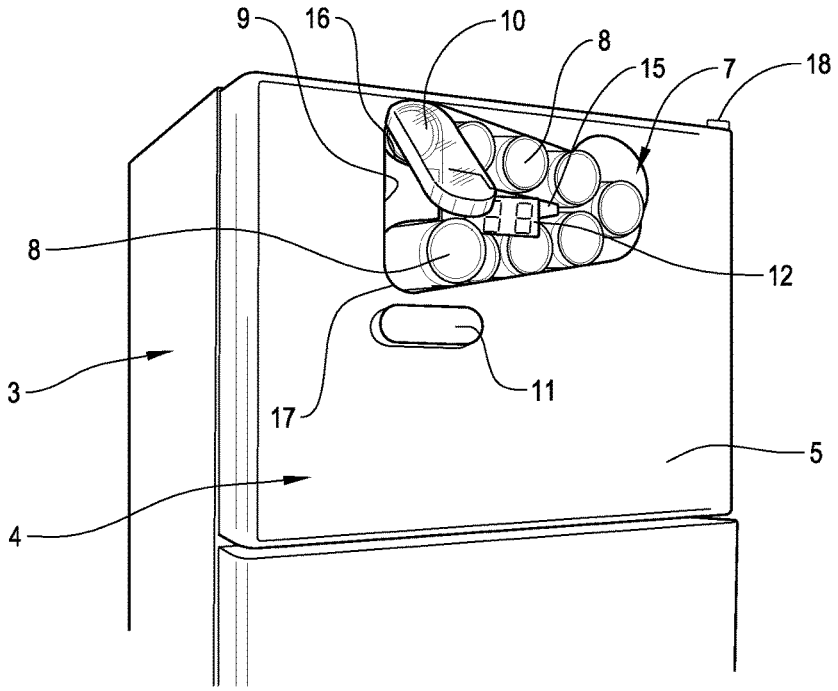
FIG. 3 shows a perspective and partial sectional view of the interior of the upper door of the freezer, provided with the cooling arrangement of the invention, where a plurality of cans is shown.
Figure 4:
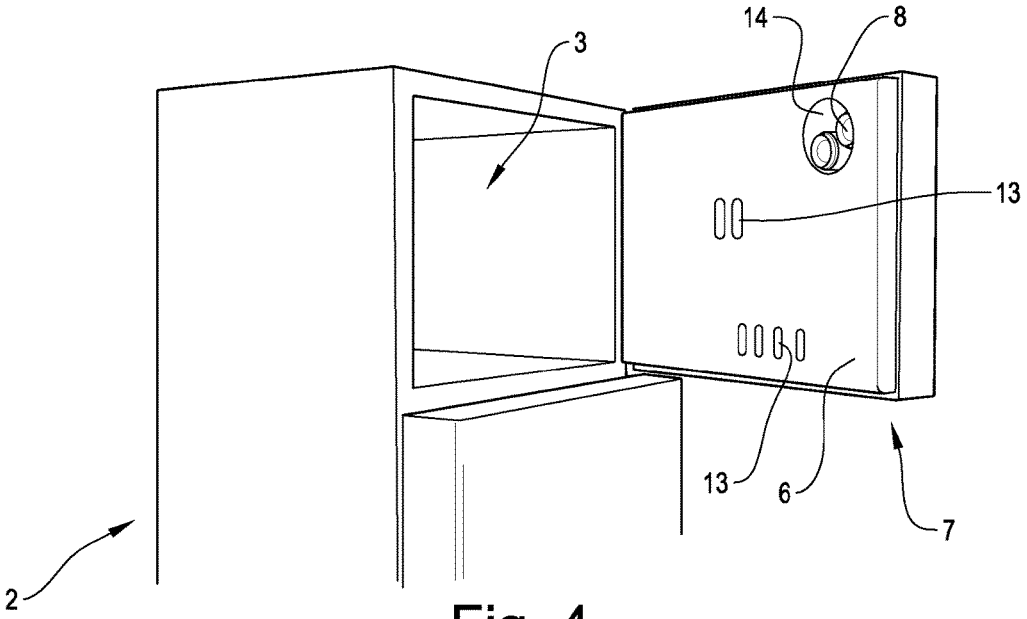
FIG. 4 shows a perspective view of the upper door of the freezer, provided with the sectored cooling arrangement of the invention, opened for accessing the cooling chamber such as the freezer.
Figure 5:
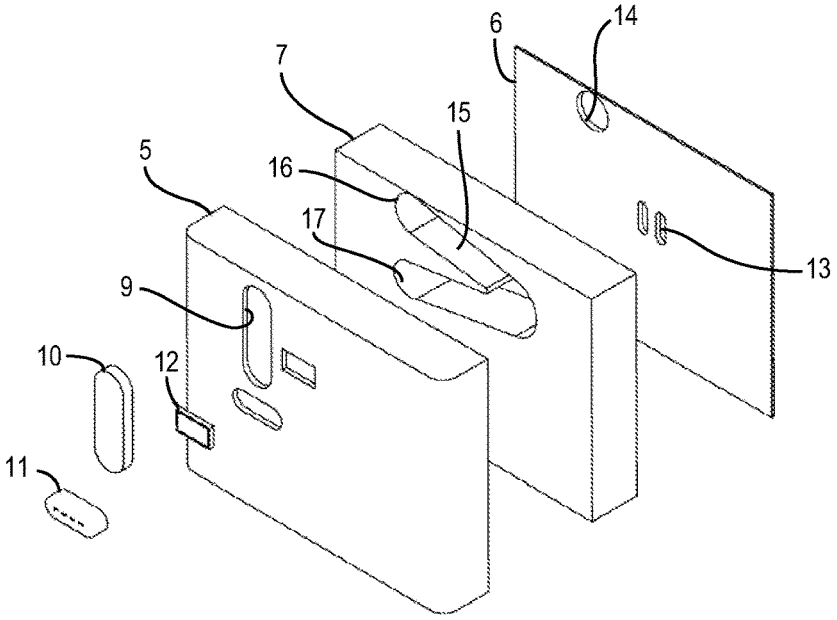
FIG. 5 shows an exploded view of the cooling arrangement of the invention.

Referring now to the figures, it is seen that the invention consists of a new cooling arrangement of selected and controlled temperature for products that require so, particularly beverages packaged in cans, allowing them to be deposited and removed without having to open other cooling chamber of the refrigerator and thus avoiding the abrupt movement thereof that can generate further unwanted overflows of the liquid contents.

It is so, in accordance with FIGS. 1 to 6, the cooling arrangement for refrigerators of the present invention is indicated by the general reference 1 and it can be used in a refrigerator 2 having a main cooling sector with a main access door to the main sector and a freezer or cooling chamber sector 3 with an access door 4. Wherein, said access door 4 comprises a compartment defined by a front panel 5, an inner panel 6 and an inclined housing structure 7 for consumer products such as cans 8.

Figure 6:
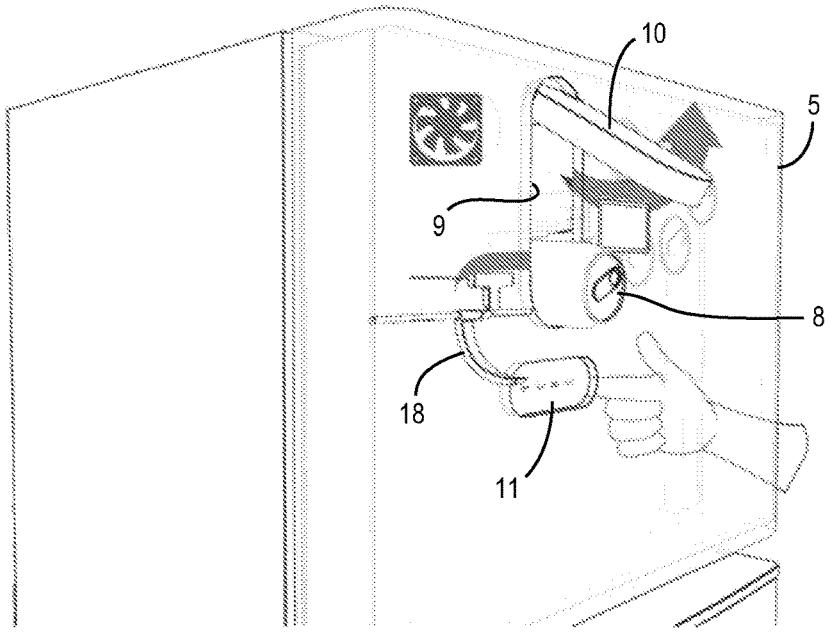
FIG. 6 shows a perspective view of the cooling arrangement of the invention in one of its applications by way of example.

Said front panel 5 is provided with a display/unloading window 9 together with a pivotable closure flap 10 which is fixedly and pivotally arranged at the top of said window 9, and which is operatively connected to an actuating button 11 provided on the front panel 5. Thus, when the button 11 is pressed or pushed, the same drives a trigger 18 which opens the closure flap 10 that pivot up and thus facilitate unloading and removal of cans 8 through the window 9, as shown in FIG. 6. It is emphasized that, said closure flap 10 is mounted on the window 9 through a hinge system (not shown), being that said flap 10 may be made of a material selected from the group consisting of plastic with insulation capacity. On the other hand, said front panel 5 can present a display screen 12 of the temperature inside the compartment.

For its part, said inner panel 6 is provided with a plurality of slots 13 which allow passage and circulation of cold air from the cooling chamber 3 to the compartment and vice versa to maintain the containers or cans at constant temperature. Likewise, said inner panel 6 has a loading window 14 disposed at an upper portion thereof. Regarding the inclined housing structure 7, it comprises a V-shaped horizontal sectioned ramp 15 which has an initial upper end 16 and a final lower end 17. Thus, the display/unloading window 9 of the front panel 5 is coincident with the initial upper end 16 and the final lower end 17, while the loading window 14 of the inner panel 6 is coincident with the initial upper end 16.

Thus, the cans 8 are loaded or deposited through the loading window 14, they are moved by gravity from the upper end 16 to the lower end 17 and can be withdrawn through the display/unloading window 9 prior triggering of the button 11 which triggers said closure flap 10. Being subjected under the action of gravity, the replacement of the cans in the lower end 17 of the sectioned ramp 15 is done automatically and sequentially as they are withdrawn one after another.

Likewise, said inclined housing structure 7 comprises a reinforced plastic material, aluminum, or steel. Said front panel 5, said inclined housing structure 7 and said inner panel 6 can form a pivot assembly in the refrigerator 2 by means of at least one assembly opening hinge for accessing the cooling chamber 3. It is noted that such inclined housing structure 7 can have at least one temperature sensor (not shown) which is connected to said display screen 12.

Thus, the cooling arrangement for refrigerators of the present invention is constructed and constituted, wherein a better control and maintenance of temperature is allowed, so that the beverages contained in cans can be consumed in a better way. Furthermore, by providing a space dedicated to cans, the invention prevents them from suffering abrupt shifts from one side to the other as happens with conventional refrigerators.

The invention claimed is:

1. A cooling arrangement for a refrigerator having an access door defining an access to a cooling chamber of the refrigerator, wherein:

said access door comprises a compartment defined by a front panel, an inner panel, and a inclined housing structure for storing a plurality of consumer products, said front panel being provided with a display/unloading window and a pivotable closure flap, said inner panel includes a plurality of slots for allowing the passage and circulation of cold air from the cooling chamber of the refrigerator to the compartment and a loading window for loading the consumer products onto the inclined housing structure.

2. The cooling arrangement according to claim 1, wherein the refrigerator has a main cooling sector with a main access door to said main sector and a freezer sector as the cooling chamber with the access door.

3. The cooling arrangement according to claim 1, wherein said inclined housing structure comprises a V-shaped horizontal sectioned ramp and having an initial upper end and a final lower end and further comprises a reinforced plastic material, aluminum, steel or a combination thereof.

4. The cooling arrangement according to claim 1, wherein said display/unloading window of the front panel is coincident with an initial upper end and the final lower end of the sectioned ramp while said pivotable closure flap is pivotally fixed at the top of said unloading window.

5. The cooling arrangement according to claim 4, wherein said pivotable closure flap is operatively connected to an actuating button arranged on the front panel via a trigger, wherein the closure flap is made of a material selected from the group consisting of plastic with insulation capacity.

6. The cooling arrangement according to claim 1, wherein said loading window of the inner panel is coincident with an initial upper end of the sectioned ramp.

7. The cooling arrangement according to claim 1, wherein said front panel of the refrigerator door, said inclined housing structure and said inner panel form a pivot assembly in the refrigerator by means of at least a first assembly opening hinge for accessing the cooling chamber.

8. The cooling arrangement according to claim 7, wherein said inclined housing structure has at least one temperature sensor.

9. The cooling arrangement according to claim 7, wherein said front panel presents a temperature display screen within said compartment.

* * * * *